US006823309B1

(12) United States Patent
Kato et al.

(10) Patent No.: US 6,823,309 B1
(45) Date of Patent: Nov. 23, 2004

(54) SPEECH SYNTHESIZING SYSTEM AND METHOD FOR MODIFYING PROSODY BASED ON MATCH TO DATABASE

(75) Inventors: Yumiko Kato, Neyagawa (JP); Kenji Matsui, Ikoma (JP); Takahiro Kamai, Soraku-gun (JP); Katsuyoshi Yamagami, Moriguchi (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/701,183

(22) PCT Filed: Mar. 27, 2000

(86) PCT No.: PCT/JP00/01870

§ 371 (c)(1),
(2), (4) Date: Nov. 27, 2000

(87) PCT Pub. No.: WO00/58943

PCT Pub. Date: Oct. 5, 2000

(30) Foreign Application Priority Data

Mar. 25, 1999 (JP) ..... H11-081124
Jul. 19, 1999 (JP) ..... H11-204167

(51) Int. Cl.[7] ..... G10L 13/08
(52) U.S. Cl. ..... 704/267
(58) Field of Search ..... 704/268, 267, 704/266, 260, 258

(56) References Cited

U.S. PATENT DOCUMENTS 5,636,325 A * 6/1997 Farrett ..... 704/258
5,905,972 A 5/1999 Huang et al. ..... 704/268
6,101,470 A * 8/2000 Eide et al. ..... 704/260
6,226,614 B1 * 5/2001 Mizuno et al. ..... 704/260
6,260,016 B1 * 7/2001 Holm et al. ..... 704/260
6,665,641 B1 * 12/2003 Coorman et al. ..... 704/260

FOREIGN PATENT DOCUMENTS

EP 0 833 304 A2 * 1/1998 ..... 704/268
JP 04-134499 5/1992
JP 08-087297 4/1996
JP 08-190397 7/1996
JP 10-116089 5/1998
JP 10-254471 9/1998

OTHER PUBLICATIONS

"McGraw–Hill Dictionary of Scientific and Technical Terms," Fifth Ed., Sybil P. Parker, ed., 1994, pp. 437 and 1311.*
U.S. Provisional Application 60/108,201.*

* cited by examiner

*Primary Examiner*—Richemond Dorvil
*Assistant Examiner*—Donald L. Storm
(74) *Attorney, Agent, or Firm*—Parkhurst & Wendel, L.L.P.

(57) ABSTRACT

A speech synthesis system for storing in advance a degree of modification of prosodic data in a prosodic data modifying rule apparatus, the degree of modification corresponding to an approximate cost and being stored as a modifying rule, a prosodic data retrieving section for retrieving a prosodic data stored corresponding to a key data for use in retrieval, the prosodic data retrieved according to a degree of matching between the input data and the key data, the degree of matching represented by the approximate cost, a modifying section for modifying the retrieved prosodic data based on the degree of matching and the modifying rule stored in the prosodic data modifying rule means, and an output section for outputting synthesized speech based on the input data and the modified prosodic data.

43 Claims, 13 Drawing Sheets

| Input Letter String Corresponding To An Accent Phrase | A:Output From Language Processing Section 120 | | B:Output From Prosodic Data Retrieving Section 140 | | C:Output From Prosodic Data Modifying Section 150 | |
|---|---|---|---|---|---|---|
| 門真市 | Phonetic Character String | Kadoma'shi/0 | Fundamental Frequency Pattern | | Fundamental Frequency Pattern | |
| | Linguistic Data (Syntactic Data, Semantic Data) | Noun Name Of Place (Address) | Voice Intensity Pattern | | Voice Intensity Pattern | |
| | | | Phonological Segment Duration Pattern | k a do ma sh i | Phonological Segment Duration Pattern | k a do ma sh i |
| 門真 | Phonetic Character String | Ka'doma /50 | Fundamental Frequency Pattern | | Fundamental Frequency Pattern | |
| | Linguistic Data | Noun Name Of Place (Address) | Voice Intensity Pattern | | Voice Intensity Pattern | |
| | | | Phonological Segment Duration Pattern | k a do ma | Phonological Segment Duration Pattern | k a do ma |
| 6番地までの | Phonetic Character String | Roclkuba' Nclchimadeno/0 | Fundamental Frequency Pattern | | Fundamental Frequency Pattern | |
| | Linguistic Data | Noun/Postposition /Postposition Name Of Place (Address)/Terminus | Voice Intensity Pattern | | Voice Intensity Pattern | |
| | | | Phonological Segment Duration Pattern | r o k k u b a N ch i m a d e n o | Phonological Segment Duration Pattern | r o k k u b a N ch i m a d e n o |

P

FIG. 2

Stored Data In Prosodic Information Database 130 FIG. 3

| Retrieval Key | | | | | | | Prosodic Data | | |
|---|---|---|---|---|---|---|---|---|---|
| Phoneme String | Accent Position | Number Of Mora | Length Of Immediately Preceding Pause | Length Of Immediately Following Pause | Syntactic Data · Semantic Data: Order Of Parts Of Speech | Syntactic Data · Semantic Data: "Bunsetsu" Data | Fundamental Frequency Pattern | Voice Intensity Pattern | Phonological Segment Duration Pattern |
| minamino kaijo-niwa | 9 | 10 | Beginning Of Sentence | Short (>0 ≦100) | Noun/ Postposition/ Noun/ Postposition/ Postposition | Adnominal Type; Direction /Advervial Type;Point Of Place | | | m:87 i:91 n:73 a:82 m:78 i:79 n:65 o:66 c:15 k:22 a:64 i:124 j:62 o:48 i:89 n:57 n:65 w:37 a:52 |
| te-kiatsuqa | 3 | 6 | Short (>0 ≦100) | Absent (0) | Noun/ Postposition | Adnominal Type Case; Weather | | | t:17 e:66 e:67 k:26 i:23 t:60 a:82 cl:15 ts:18 u:58 q:41 a:49 |
| ari | 1 | 2 | Absent (0) | Long (>100) | Verb | Adnominal Type; Termination;Existence | | | a:72 r:11 i:76 |
| hoNshu- | 1 | 4 | Long (>100) | Absent (0) | Noun | Adnominal Type 1/ 2;Name Of Place | | | |

FIG. 5

Input Text「門真市門真6番地までの所要時間は35分です。」

| Input Text | Search Key Phonetic Character String | Retrieval Key Phonetic Character String | Desired Way Of Modifying Prosodic Data According To Degree Of Matching Between Each Retrieval Item (Increase/Decrease In Value) | | | | | | | Desired Way Of Modifying Prosodic Data In Total |
|---|---|---|---|---|---|---|---|---|---|---|
| | | | Phoneme String | Accent | Number Of Mora | Immediately Preceding Pause | Immediately Following Pause | Order Of Parts Of Speech | "Bunsetu" Data | |
| 門真市 | kadoma'shi | nagoya'shi | — | — | — | — | — | — | — | — |
| | | | | | | | | | | |
| 3 | sa'Nju- | ka'Nclto- | — | — | — | ↘ | — | — | ↗ | ↗ |
| 5分です | go'fuNdesxu | na'ruNdesxu | — | — | — | — | — | ↘ | ↗ | ↗ |

Stored Data In Prosodic Information Database 230 FIG. 7

| Retrieval Key | | | | | Prosodic Data | | | | |
|---|---|---|---|---|---|---|---|---|---|
| Phoneme String | Accent Position | Number Of Mora | Syntactic Data · Semantic Data | | Fundamental Frequency Pattern | Voice Intensity Pattern | Phonological Segment Duration Pattern | Pouse Data | |
| | | | Order Of Parts Of Speech | "Bunsetsu" Data | | | | Length Of Immediately Preceding Pause | Length Of Immediately Following Pause |
| minamino kaijo-niwa | 9 | 10 | Noun/ Postposition/ Noun/ Postposition/ Postposition | Adnominal Type; Direction /Advervial Type;Point Of Place | | | m:87<br>i:91<br>n:73<br>a:82<br>m:78<br>i:79<br>n:65<br>o:66<br>cl:15<br>k:22<br>a:64<br>i:124<br>j:62<br>o:48<br>i:89<br>n:57<br>i:65<br>w:37<br>a:52 | Beginning Of Sentence | 34 |
| te-kiatsuqa | 3 | 6 | Noun/ Postposition | Adnominal Type Case; Weather | | | t:17<br>e;66<br>i:67<br>cl:26<br>k:23<br>i:60<br>a;82<br>cl:15<br>ts:18<br>u:58<br>q:41<br>a;49 | 34 | 0 |
| ari | 1 | 2 | Verb | Adnominal Type Terminating;Existence | | | a:72<br>r:11<br>i:76 | 0 | 122 |
| hoNshu- | 1 | 4 | Noun | Adnominal Type 1/ 2;Name Of Place | | | h:26<br>o:53<br>N:72<br>sh:36 | 122 | 0 |

FIG. 10

Portion Of Stored Data In Prosodic Information Database 430

| Retrieval Key | | | | | | Prosodic Data | |
|---|---|---|---|---|---|---|---|
| | | | | Syntactic Data · Semantic Data | | Pause Data | |
| Phoneme String | Accent Position | Number Of Accent Phrase | Number Of Mora | Order Of Parts Of Speech | "Bunsetsu" Data | Length Of Immediately Preceding Pause | Length Of Immediately Following Pause |
| minamino kaijo-niwa | 9 | 1 | 10 | Noun/ Postposition/ Noun/ Postposition/ Postposition | Adnominal Type; Direction /Advervial Type;Point Of Place | Beginning Of Sentence | 34 |
| te-kiatsuqa /ari | 3,7 | 2 | 8 | Noun/ Postposition/ Verb | Adnominal Type Case;Weather/ Adnominal Type Terminating; Existence | 34 | 122 |
| hoNshu-/ clchu-buno/ cltaihe-yo-gawawa | 1,5,10,11 | 3 | 17 | Noun/Noun Postposition/ Noun/ Postposition/ Postposition | Adnominal Type;Name Of Place, Point Of Place /Advervial Type;Name Of Place,Point Of Place | 122 | 0 |

Example Of Categories And Psychological Distances Obtained By Multidimetional Scaling

SPEECH SYNTHESIZING SYSTEM AND METHOD FOR MODIFYING PROSODY BASED ON MATCH TO DATABASE

TECHNICAL FIELD

The present invention relates to a speech synthesis system in which arbitrary input texts, input phonetic characters, or the like are converted into synthesized speech to be output therefrom.

BACKGROUND ART

In recent years, synthesized speech has been widely used in electric home appliances and various electronic appliances such as vehicle navigation systems and mobile phones, in which various speech messages such as conditions of the appliances, instructions for operation, and response messages, are voiced by synthesized speeches. In addition, synthesized speeches have begun to be employed in personal computers or the like for such purposes as operating the apparatuses by way of a voice interface and confirming the result of text recognition by optical character recognition (OCR).

One of the techniques for performing such a speech synthesis is that speech data are stored in a system in advance and the stored data are played back when required. This technique is widely used in cases where a limited number of messages are to be vocalized. However, when a system according to this technique is applied to generate arbitrary speeches, the system requires a large capacity storage system, which inevitably makes the system costly and thus limiting the application thereof.

Another technique that is used in relatively less expensive systems than the above is such a system wherein, based on input texts or phonetic character strings, speech data are generated using a predetermined speech data generating rule. However, by this technique that utilizes the speech data generating rule, it is difficult to generate natural sounding speeches with various kinds of expressions.

In view of these problems, Japanese Unexamined Patent Publication No. 8-87297, for example, discloses a speech synthesis system that employs both the speech synthesis by retrieving speech data from a database and the speech synthesis by using a speech sound generating rule. More specifically, this type of apparatus has, as shown in FIG. 13, a text input section 910, a speech information database 920 storing speech parameters and corresponding speech content data, the speech parameters being obtained by analyzing actual speech and extracting data therefrom, a speech data retrieving section 930 retrieving data from the speech information database 920, a speech sound generating section 940 generating a speech waveform, a speech sound generating rule 950 including a rule for generating a speech parameter from the input text or the input phonetic character string, and an electroacoustic transducer 960. This speech synthesis system operates in the following manner. If a text or a phonetic character string is inputted into the text input section 910, the speech data retrieving section 930 retrieves from the speech information database 920 speech data having speech content that matches the input text or the input phonetic character string. If a matching speech content is present in the database, corresponding speech data is transmitted to the speech sound generating section 940. If the matching speech content is absent, the speech data retrieving section 930 transmits the input text or the input phonetic character string as it is to the speech sound generating section 940. When the speech sound generating section 940 receives the retrieved speech data, the speech sound generating section 940 generates a synthesized speech based on the retrieved speech data. Alternatively, when the speech sound generating section 940 receives the input text or the input phonetic character string, the speech sound generating section 940 generates speech parameters based on the input text or input phonetic character string and the speech sound generating rule 950, and thereafter generates a synthesized speech.

By using the speech data retrieval and the speech sound generating rule as described above, an arbitrary input text can be converted into a synthesized speech to be outputted, and for a limited portion of the speech (where the retrieval can find a successful match), a natural sounding speech can be obtained.

One of the drawbacks of the above-described prior art speech synthesis system is that there is a large difference in the sound quality between a synthesized speech in which the search has found a successful match and a synthesized speech in which the search has not found a successful match, that is, between a case where a speech content data corresponding to the input text or the like is present in the speech information database and a case where the corresponding speech content data is absent. In addition, by concatenating such speeches having different sound qualities, the resulting synthesized speech becomes further unnatural. Further, the retrieval from the speech information database 920 is performed by simply detecting the presence or absence of matching between the input phonetic character string and the stored speech content data, and therefore when a matching speech content data is present in the database, the speech synthesis is performed based on the retrieved data, regardless of other actors such as construction of the sentence, also leading to unnatural synthesized speech.

Specifically, assume that the system is required to synthesize a sentence in Japanese "大阪に住んでいる私は松下です。(which is transcribed in the Roman alphabet as 'Osaka ni sunde iru watashi wa Matsushita desu', which means that 'I, who live in Osaka, am Matsushita.')", for example. In this case, if the proper noun "Matsushita" is absent in the database, the corresponding portion of the speech tends to become a mechanical sounding synthesized speech. Also, when the speech content data corresponding to the clause "Osaka ni sundeiru" which is stored as a speech data of the end of a sentence is used to construct the required sentence, the resulting speech tends to become an unnatural sounding synthesized speech such that two separate sentences "大阪に住んでいる ('osaka ni sunde iru', meaning 'I live in Osaka')" and "私は松下です ('watashi wa Matsushita desu', meaning 'I am Matsushita')" are unnaturally concatenated.

DISCLOSURE OF THE INVENTION

In view of the foregoing and other drawbacks of prior art, it is an object of the present invention to provide a speech synthesis system capable of generating natural sounding synthesized speeches from arbitrary input texts, particularly a speech synthesis system capable of generating natural sounding synthesized speech having a good sound quality regardless of whether or not the speech information (prosodic information) database contains speech content data that matches the input text.

This and other objects are accomplished, in a first aspect of the present invention, by the provision of a speech synthesis system for generating a synthesized speech based on input data representing a speech to be synthesized, the system comprising:

a database storing prosodic data for use in synthesizing speech, the prosodic data corresponding to key data being used as a retrieval key;

means for retrieving the prosodic data according to a degree of matching between the input data and the key data;

means for modifying the prosodic data retrieved by the means for retrieving based on the input data, the degree of matching between the input data and the key data, and a predetermined modifying rule; and means for synthesizing a synthesized speech based on the input data and the prosodic data modified by the means for modifying.

A second to a six aspects of the invention are as follows. The input data and the key data may include a phonetic character string representing a phonetic attribute of the speech to be synthesized, and further include linguistic data representing a linguistic attribute of the speech to be synthesized. The phonetic character string may include a data substantially indicating at least one of a phonological segment string of the speech to be synthesized, an accent position in the speech to be synthesized, and either one of the presence or absence and the length of a pause in the speech to be synthesized. Further, the linguistic data may include at least one of syntactic data and semantic data of the speech to be synthesized.

In addition, the speech synthesis system may further comprise a language processing means parsing a text data inputted in the speech synthesis system and producing the phonetic character string and the linguistic data.

By employing the above configurations of the invention, even when even where the database does not contain such prosodic data that the input data and the key data exactly match, a speech synthesis system can perform speech synthesis by using similar prosodic data, achieving a reasonably appropriate, smooth, and natural sounding speech based on arbitrary input data. Alternatively, the system can reduce a required storage capacity of the database without causing degradation in naturalness of the synthesized speech. Furthermore, where similar prosodic data are used as mentioned above, the prosodic data are modified according to a degree of similarity thereof, and therefore, more appropriate synthesized speech can be produced.

A seventh to a 15th aspects of the invention are as follows. In accordance with a seventh aspect of the invention, there is provided a speech synthesis system according to the first aspect of the invention, wherein each of the input data and the key data substantially includes a phonological segment category string representing a phonological segment category to which a phonological segment in the speech to be synthesized belongs.

Further, a speech synthesis system according to the invention may further comprises means for converting data into the phonological segment category string, the data being at least one data of data corresponding to the input data inputted to the speech synthesis system and data corresponding to the key data stored in the database.

The phonological segment category may be such that phonological segments are categorized by using at least one of a manner of articulation thereof, a place of articulation thereof, and a duration thereof.

The phonological segment category may also be such that prosodic patterns are grouped by using a statistical method such as a multivariate analysis or the like, and that the phonological segments are grouped so as to best reflect the grouped prosodic patterns.

The phonological segment category may also be such the phonological segments are grouped according to a distance between the phonological segments each other, the distance being determined based on a confusion matrix by using a statistical method such as a multivariate analysis.

The phonological segment category may also be such that the phonological segments are grouped according to a similarity of a physical characteristic between the phonological segments, such as a fundamental frequency thereof, an intensity thereof, a duration thereof, and a spectrum thereof.

By employing the above-described configurations of the invention, when the phonemes do not match but the phonological segment categories match each other in the retrieval of prosodic data, an appropriate and natural sounding speech can be produced in most cases by utilizing the prosodic data of non-matching phonemes.

In accordance with a 16th aspect of the invention, there is provided a speech synthesis system according to the first aspect of the invention, wherein the prosodic data stored in the database includes prosodic feature data extracted from an identical actual human voice.

In accordance with a 17th aspect of the invention, there is provided a speech synthesis system according to the 16th aspect of the invention, wherein the prosodic feature data include at least one of:

a fundamental frequency pattern representing a variation of a fundamental frequency with respect to time;

a voice intensity pattern representing a variation of a voice intensity with respect to time;

a phonological segment duration pattern representing a duration of a phonological segment; and a pause data representing one of the presence or absence of a pause and the length of a pause.

In accordance with a 18th aspect of the invention, there is provided a speech synthesis system according to the first aspect of the invention, wherein the prosodic data are stored in the database such that each prosodic data forms a prosody controlling unit.

In accordance with a 19th aspect of the invention, there is provided a speech synthesis system according to the 18th aspect of the invention, wherein the prosody controlling unit comprises one of:

an accent phrase;

a phrase comprising one or more accent phrase;

a bunsetsu;

a phrase comprising one or more bunsetsus;

a word;

a phrase comprising one or more words;

a stress phrase; and a phrase comprising one or more stress phrases.

By employing the above-described configuration of the invention, a system according to the invention can easily achieve an appropriate and natural sounding synthesized speech.

In accordance with a 20th aspect of the invention, there is provided a speech synthesis system according to the first aspect of the invention, wherein:

each of the input data and the key data comprises a plurality of types of speech indices each being a factor in determining a speech to be synthesized; and the degree of matching between the input data and the key data is such that in each type of the speech indices, a degree of matching between the input data and the key data is weighted, and the weighted data are combined together.

In accordance with a 21st aspect of the invention, there is provided a speech synthesis system according to the 20th aspect of the invention, wherein the speech indices include a data substantially indicating at least one of a phonological segment string of the speech to be synthesized, an accent position in the speech to be synthesized, a linguistic data representing a linguistic attribute of the speech to be synthesized and one of the length of a pause and the presence or absence in the speech to be synthesized.

In accordance with a 22nd aspect of the invention, there is provided a speech synthesis system according to the 21st aspect of the invention, wherein:

the speech indices include a data substantially indicating a phonological segment string of the speech to be synthesized; and the degree of matching between the speech indices in the input data and the speech indices in the key data includes a degree of similarity of acoustic feature data between phonological segments.

In accordance with a 23rd aspect of the invention, there is provided a speech synthesis system according to the 20th aspect of the invention, wherein the speech indices substantially include a phonological segment category string representing a phonological segment category to which a phonological segment in the speech to be synthesized belongs.

In accordance with a 24th aspect of the invention, there is provided a speech synthesis system according to the 23rd aspect of the invention, wherein the degree of matching between the speech indices in the input data and the speech indices in the key data includes a degree of similarity of the phonological segment category between the phonological segments.

By employing the above configurations of the invention, the retrieving and modifying of prosodic data can be easily performed in an appropriate manner.

In accordance with a 25th aspect of the invention, there is provided a speech synthesis system according to the 20th aspect of the invention, wherein the prosodic data includes a plurality of types of prosodic feature data characterizing the speech to be synthesized.

In accordance with a 26th aspect of the invention, there is provided a speech synthesis system according to the 25th aspect of the invention, wherein the database stores the plurality of types of prosodic feature data in such a manner that the plurality of types of prosodic feature data constitute a set of prosodic feature data.

In accordance with a 27th aspect of the invention, there is provided a speech synthesis system according to the 26th aspect of the invention, wherein the plurality of types of prosodic feature data are extracted from an identical actual human voice.

In accordance with a 28th aspect of the invention, there is provided a speech synthesis system according to the 25th aspect of the invention, wherein the prosodic feature data includes at least one of:

a fundamental frequency pattern representing a variation of a fundamental frequency with respect to time;

a voice intensity pattern representing a variation of a voice intensity with respect to time;

a phonological segment duration pattern representing a duration of a phonological segment; and a pause data representing one of the presence or absence of a pause and the length of a pause.

In accordance with a 29th aspect of the invention, there is provided a speech synthesis system according to the 28th aspect of the invention, wherein the phonological segment duration pattern includes at least one of a phoneme duration pattern, a mora duration pattern, and a syllable duration pattern.

In accordance with a 30th aspect of the invention, there is provided a speech synthesis system according to the 25th aspect of the invention, wherein each of the plurality of types of prosodic feature data is retrieved and modified according to the weighted degrees of matching between the input data and the key data, the weighted degrees of matching being different from each other.

In accordance with a 31st aspect of the invention, there is provided a speech synthesis system according to the 20th aspect of the invention, wherein the retrieving the prosodic data and the modifying the prosodic data are performed each using a different weighted degree of matching between the input data and the key data.

In accordance with a 32nd aspect of the invention, there is provided a speech synthesis system according to the 20th aspect of the invention, wherein the retrieving the prosodic data and the modifying the prosodic data are performed using an identical weighted degree of matching between the input data and the key data.

In accordance with a 33rd aspect of the invention, there is provided a speech synthesis system according to the first aspect of the invention, wherein the means for modifying modifies the prosodic data retrieved by the means for retrieving based on a degree of matching between one of:

each phoneme;

each mora;

each syllable;

each unit of generating a speech waveform in the means for synthesizing; and each phonological segment.

By employing the above-described configuration of the invention, modifying the prosodic data is easily performed in an appropriate manner.

In accordance with a 34th aspect of the invention, there is provided a speech synthesis system according to the 33rd aspect of the invention, wherein the degree of matching is determined based on at least one of:

a distance based on an acoustic characteristic;

a distance obtained from one of a manner of articulation, a place of articulation, and a duration; and a distance based on a confusion matrix obtained by an auditory experiment.

In accordance with a 35th aspect of the invention, there is provided a speech synthesis system according to the 34th aspect of the invention, wherein the acoustic characteristic is at least one characteristic of the phonological segments selected from a fundamental frequency thereof, an intensity thereof, a duration thereof, and a spectrum thereof.

In accordance with a 36th aspect of the invention, there is provided a speech synthesis system according to the first aspect of the invention, wherein the database stores key data and prosodic data of a plurality of types of languages.

By employing the above configuration of the invention, a synthesized speech containing a plurality of languages can be easily produced.

In accordance with a 37th aspect of the invention, there is provided a method of synthesizing a speech based on input data representing a speech to be synthesized, the method comprising:

retrieving a prosodic data from a database in which a prosodic data for use in synthesizing a speech is stored corresponding to a key data for use in retrieval, the prosodic data retrieved according to a degree of matching between the input data and the key data;

modifying the retrieved prosodic data based on the degree of matching between the input data and the key data and a predetermined modifying rule; and outputting a synthesized speech based on the input data and the modified prosodic data.

In accordance with a 38th aspect of the invention, there is provided a method of synthesizing a speech according to the 37th aspect of the invention, wherein each of the input data and the key data includes a plurality of types of speech indices each being a factor in determining a speech to be synthesized;

the degree of matching between the input data and the key data is such that in each type of the speech indices, a degree of matching between the input data and the key data is weighted, and the weighted data are combined together.

In accordance with a 39th aspect of the invention, there is provided a method of synthesizing a speech according to the 38th aspect of the invention, wherein the prosodic data includes a plurality of types of prosodic feature data characterizing the input data.

In accordance with a 40th aspect of the invention, there is provided a method of synthesizing a speech according to the 39th aspect of the invention, wherein each of the plurality of types of prosodic feature data is retrieved and modified according to the weighted degrees of matching between the input data and the key data, the weighted degrees of matching being different from each other.

In accordance with a 41st aspect of the invention, there is provided a method of synthesizing a speech according to the 38th aspect of the invention, wherein the retrieving the prosodic data and the modifying the prosodic data are performed each using a different weighted degree of matching between the input data and the key data.

In accordance with a 42nd aspect of the invention, there is provided a method of synthesizing a speech according to the 38th aspect of the invention, wherein the retrieving the prosodic data and the modifying the prosodic data are performed using an identical weighted degree of matching between the input data and the key data.

By employing the above-described methods according to the invention, even where the database does not contain such prosodic data that the input data and the key data exactly match, the speech synthesis system can perform speech synthesis by using similar prosodic data, achieving a reasonably appropriate, smooth, and natural sounding speech based on arbitrary input data. Alternatively, the system can reduce a required storage capacity of the database without causing degradation in naturalness of the synthesized speech. Furthermore, where similar prosodic data are used as mentioned above, the prosodic data are modified according to a degree of similarity thereof, and therefore, more appropriate synthesized speech can be produced.

In accordance with a 43rd aspect of the invention, there is provided a speech synthesis system wherein an input text is converted into a synthesized speech to be outputted, the system comprising:

a language processing means wherein the input text is parsed so as to output a phonetic character string and linguistic data;

a prosodic information database storing prosodic feature data, linguistic data, and a phonetic character string so that the prosodic feature data correspond to the linguistic data and the phonetic character string, the prosodic feature data being extracted from actual human speech, and phonetic character string and the linguistic data corresponding to a speech to be synthesized;

a retrieving means for retrieving a prosodic feature data from the prosodic feature data stored in the prosodic information database, the retrieved prosodic feature data corresponding to at least a portion of retrieval items composed of the phonetic character string and the linguistic data outputted from the language processing means;

a prosody modifying means for modifying the prosodic feature data according to a predetermined rule in response to a degree of matching between the retrieval item and the data stored in the prosodic information database, the prosodic feature data being retrieved and selected from the prosodic information database; and a waveform generating means for generating a speech waveform based on the prosodic feature data received from the prosody modifying means and the phonetic character string received from the language processing means.

The system according to this configuration of the invention also achieves a reasonably appropriate, smooth, and natural sounding speech based on an arbitrary input text.

BRIEF DESCRIPTION OF THE DRAWINGS

FIG. 2 shows examples of the data stored in each of the portions in the speech synthesis system of Example 1 in accordance with the invention.

FIG. 3 shows the data stored in a prosodic information database in the speech synthesis system of Example 1 in accordance with the invention.

FIG. 5 illustrates an example of modifying prosodic data.

FIG. 7 shows the data stored in a prosodic information database in the speech synthesis system of Example 2 in accordance with the invention.

FIG. 10 shows the data stored in a prosodic information database in the speech synthesis system of Example 4 in accordance with the invention.

BEST MODE FOR CARRYING OUT THE INVENTION

Now based on examples thereof, the details of the present invention will be discussed below.

EXAMPLE 1

Figure 1:
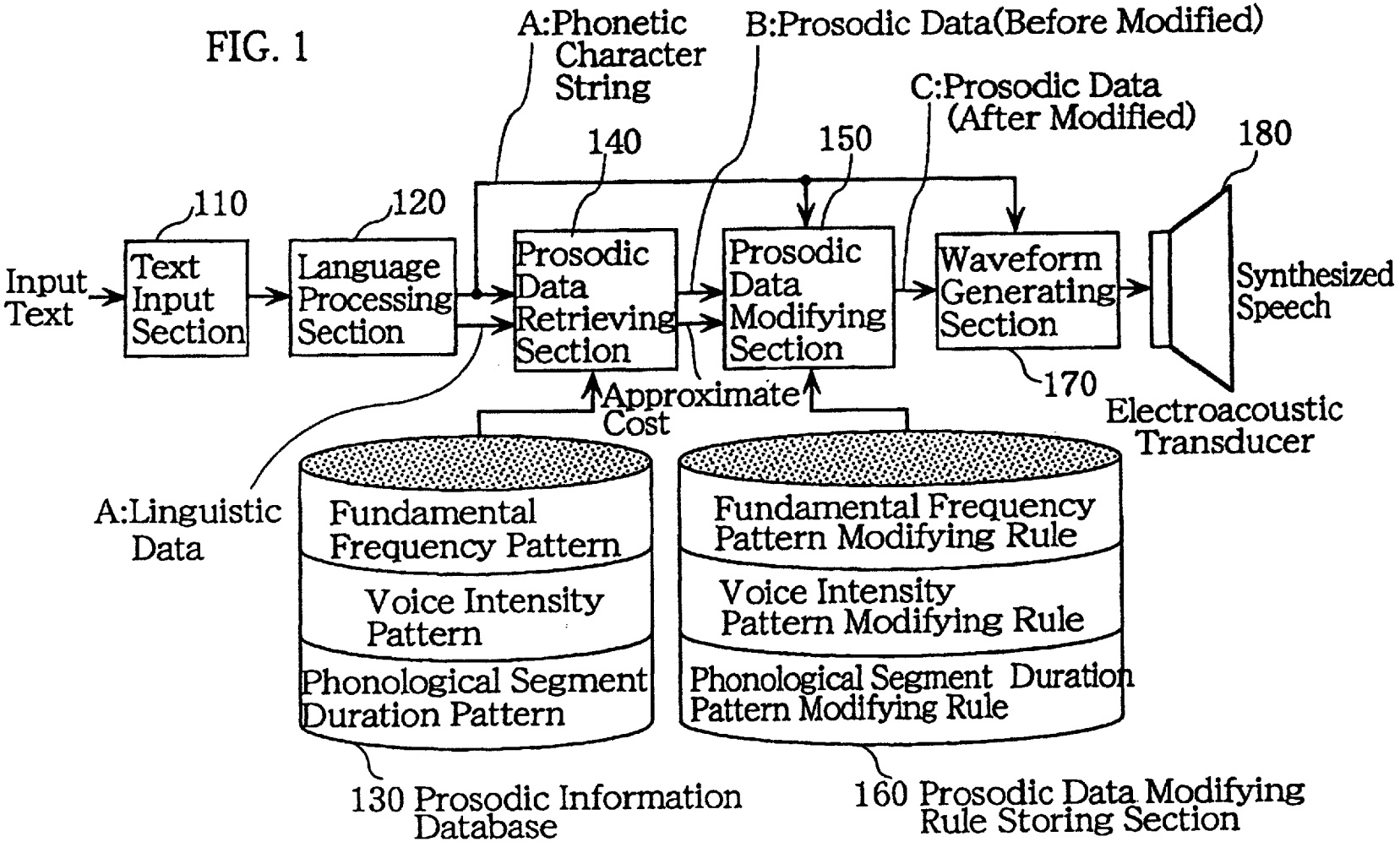
FIG. 1 is a functional block diagram for illustrating an embodiment of a speech synthesis system of Example 1 in accordance with the invention.

FIG. 1 shows a functional block diagram illustrating a configuration of a speech synthesis system of Example 1 in accordance with the present invention. Referring to FIG. 1, a text input section 110 is provided with a text such as a letter string composed of a mixture of kanji characters (Chinese characters) and kana characters (Japanese phonetic alphabet) or a letter string composed only of kana characters. For the text input section 110, specifically, an input device such as a keyboard can be employed.

A language processing section 120 performs preprocessing for the database retrieval, which will be discussed later. The language processing section 120 parses the input text and outputs a phonetic character string and linguistic data for each of accent phrases as shown in FIG. 2. An accent phrase refers to a unit for speech synthesis processing, provided for the convenience of the processing, and roughly corresponds to a bunsetsu (syntactic phrase in a Japanese sentence). The accent phrases can be made up by dividing the input text in such a manner that each accent phrase becomes suitable for speech synthesis processing, for example, in such a manner that when the input text being a two or more digit number, the number of each digit is allotted for one accent phrase. A phonetic character string may be, for example, a letter string composed of alphanumeric characters, and represents a position or positions of accent, a phoneme or phonemes, which is/are the smallest unit of sound in a speech, and the like. Linguistic data represents, for example, syntactic data (such as parts of speech) of an accent phrase, semantic data (such as semantic attributes) of an accent phrase, and the like.

A prosodic information database 130 stores, for example as shown in FIG. 3, prosodic data extracted from actual human voice for every accent phrase. The prosodic data are stored so as to correspond to corresponding retrieval keys.

The retrieval keys used in the example shown in FIG. 3 include:

(a) phoneme strings;

(b) accent positions;

(c) the numbers of morae;

(d) the lengths of pauses preceding and following the accent phrase; and (e) syntactic data and semantic data.

The prosodic data used therein include:

(a) fundamental frequency patterns;

(b) voice intensity patterns; and (c) phonological segment duration patterns.

In order to generate a natural synthesized speech, it is preferable that each of the components of the prosodic data listed above be extracted from an identical actual human voice. The numbers of morae need not to be stored in the prosodic information database 130, and instead, may be counted from the phoneme strings each time the retrieval operation is performed. In the example of FIG. 3, the length of pauses preceding and following an accent phrase also serves as the data indicating whether or not a particular accent phrase is at the start or end of the sentence. This makes it possible that even when the same accent phrases are at different positions in a sentence and thereby have different voice intensities, they can be distinguished in the retrieval and an appropriate speech can be generated. It is noted, however, that this is for illustrative purpose only, and it is possible to employ such constructions that the pause length represents only the length of a pause, and the data indicating the beginning or end of a sentence is independently provided as a separate retrieval key.

A prosodic data retrieving section 140 searches the prosodic data stored in the prosodic information database 130 in response to the output from the language processing section 120, and outputs the search result. This search and retrieval is performed by so-called approximate matching. Specifically, even when a search key (key used for searching the database) based on the output from the language processing section 120 such as a phoneme string does not exactly match a retrieval key (key in the database) in the prosodic information database 130, the retrieval keys that match the search key to a certain degree are selected as retrieval candidates, and of the selected candidates, the key having the highest degree of matching (the key in which the approximate cost is the smallest, which corresponds to the difference between the search key and the retrieval key) is selected by, for example, using a minimal cost method. That is, even when the search key and the retrieval key do not match exactly, it is made possible, by using the prosodic data of a similar accent phrase, to produce more natural sounding speeches than those generated by using a generating rule.

Based on the approximate cost used in the retrieval by the prosodic data retrieving section 140 and a prosodic data modifying rule stored in the prosodic data modifying rule storing section 160 (described later), a prosodic data modifying section 150 modifies the prosodic data retrieved by the prosodic data retrieving section 140. Specifically, when a search key exactly matches a corresponding retrieval key in the retrieval operation in the prosodic data retrieving section 140, the most appropriate speech synthesis can be performed by the retrieved prosodic data. However, when the search key and the corresponding retrieval key do not exactly match, the prosodic data of a similar accent phrase is utilized as described above. As a result of this, it is possible that the resulting synthesized speech becomes dissimilar from the desired speech and the dissimilarity is greater as the degree of matching between both keys is lower (the approximate cost is larger). In view of this problem, the retrieved prosodic data is modified according to the approximate cost in a predetermined manner, and thereby a more appropriate synthesized speech can be obtained.

A prosodic data modifying rule storing section 160 stores a modifying rule for modifying prosodic data according to the approximate cost, as discussed above.

A waveform generating section 170 synthesizes a speech waveform based on the phonetic character string received from the language processing section 120 and the prosodic data received from the prosodic data modifying section 150, and outputs a resulting analog speech signal.

An electroacoustic transducer 180 converts the analog speech signal to an audible speech. The electroacoustic transducer 180 may be a loudspeaker or headphones, for example.

Now, the speech synthesis operation of the speech synthesis system constituted as described above is discussed below.

(1) When a text to be converted is inputted to the text input section 110, the language processing section 120 parses the input text and divides it into accent phrases, and accordingly outputs phonetic character strings and linguistic data as shown in FIG. 2. More specifically, for example, when a mixed character string of kanji and kana is inputted, by using a conversion dictionary or the like such as a kanji dictionary (not shown), the input character string is divided into accent phrases and is converted into pronunciation, and accordingly a phonetic character string that represents an accent position or positions, the presence or absence and the length of a pause or pauses, and so forth, is generated. It is noted here that in the example of phonetic character strings in FIG. 2, alphanumerical and other characters represent the following data:

(a) Roman alphabet: phoneme (the character "N" represents a syllabic nasal)

(b) "'" (apostrophe): accent position (c) "/" (slash): boundary between accent phrases (d) "cl": silent portion (e) numeral: pause length It is to be noted that although it is not shown in the figure, data indicating boundaries between phrases or sentences may be included in the data represented by the phonetic character strings. The manner of notation of phonetic character strings is not limited to those shown above. Phoneme strings, values or the like indicating accent positions, and the like may be separately outputted as independent data. In addition, the linguistic data (syntactic data and semantic data) may include data other than parts of speech and meanings, for example, such as conjugated forms, the presence or absence of modification relationships, a degree of importance in popular sentences. The manner of notation thereof is not limited to the examples shown in FIG. 3 such as the character strings "noun" and "adnominal type", and coded numerals may be used, for example.

(2) The prosodic data retrieving section 140 searches and retrieves the prosodic data stored in the prosodic information database 130 based on the phonetic character string and linguistic data for each accent phrase, both of which are received from the language processing section 120, and outputs the retrieved prosodic data and an approximate cost detailed later. More specifically, when the prosodic data retrieving section 140 receives a phonetic character string notated in the above-described manner from the language processing section 120, the prosodic data retrieving section 140 firstly obtains values each indicating a phoneme string, an accent position, the number of morae, and the like from the phonetic character string, and using the values as search keys, searches the corresponding prosodic data in the prosodic information database 130. In this retrieving operation, when the retrieval key exactly matching the search key is present in the prosodic information database 130, the prosodic data corresponding to the retrieval key can be outputted as the retrieved data. However, when the exact match does not exist therein, data having a retrieval key that matches the search key to a certain degree (for example, data having a match between the phoneme strings but not having a match between the semantic data, or data not having a match between the phoneme strings but having a match between the numbers of morae and accents) are initially selected as candidates, and of the candidates, the one having the highest degree of matching between the search key and the retrieval key is selected and outputted as the retrieved data.

The selection of candidates can be performed by a minimal cost method using approximate costs. More specifically, at first, an approximate cost C is obtained in the following manner.

[Expression 1]

$$C=a1\cdot D1+a2\cdot D2+a3\cdot D3+a4\cdot D4+a5\cdot D5+a6\cdot D6+a7\cdot D7$$

In the above expression, a1, D1 . . . represent the following:

D1: the number of non-matching phonemes in the phoneme strings,

D2: the difference in the accent positions,

D3: the difference in the number of morae,

D4: the presence or absence of matching between the lengths of the immediately preceding pauses (whether or not the pause length is within the range of the retrieval key), D5: the presence or absence of matching between the lengths of the immediately following pauses (whether or not the pause length is within the range of the retrieval key), D6: the presence or absence of matching between syntactic data, or a degree thereof, D7: the presence or absence of matching between semantic data, or a degree thereof, a1–a7: coefficients of weighting for D1–D7 (coefficients obtained by a statistical method, or by learning)

It is to be understood that D1–D7 are not limited to those listed above, and various other factors may be employed as far as the factors represent a degree of matching between a search key and a retrieval key. For example, the value of D1 may be varied depending on such as positions of non-matching phonemes, whether non-matching phonemes are analogous to each other, whether non-matching phonemes occur in succession, and so forth. Regarding D4 and D5, when the pause lengths are represented by ranks, for examples, as short, long, and none as shown in FIG. 3, whether they match or not may be represented by the numerals 0 and 1, and differences in the ranks may be represented by numerical values. When the pause lengths are represented by time values, differences between the time values may be employed. Regarding D6 and D7, possible variations thereof include the following: whether the syntactic data or the semantic data matches or not may be represented by the numerals 0 and 1; by using a table including search keys and retrieval keys as parameters, a value representing a degree of matching between a search key and a retrieval key may be employed (for example, the degree of matching is low in a combination of a noun and a verb, but is high in a combination of a postposition and an auxiliary verb, etc.); or a degree of similarity in meanings between the keys may be obtained by using a thesaurus.

The approximate costs as described above are calculated for each search candidate, and a candidate having the least approximate cost is selected and retrieved as a retrieved data. This permits the speech synthesis system to produce a relatively appropriate and natural sounding speech, even when the corresponding prosodic data having such a retrieval key that exactly matches the search key is not stored in the prosodic information database 130.

Figure 4:
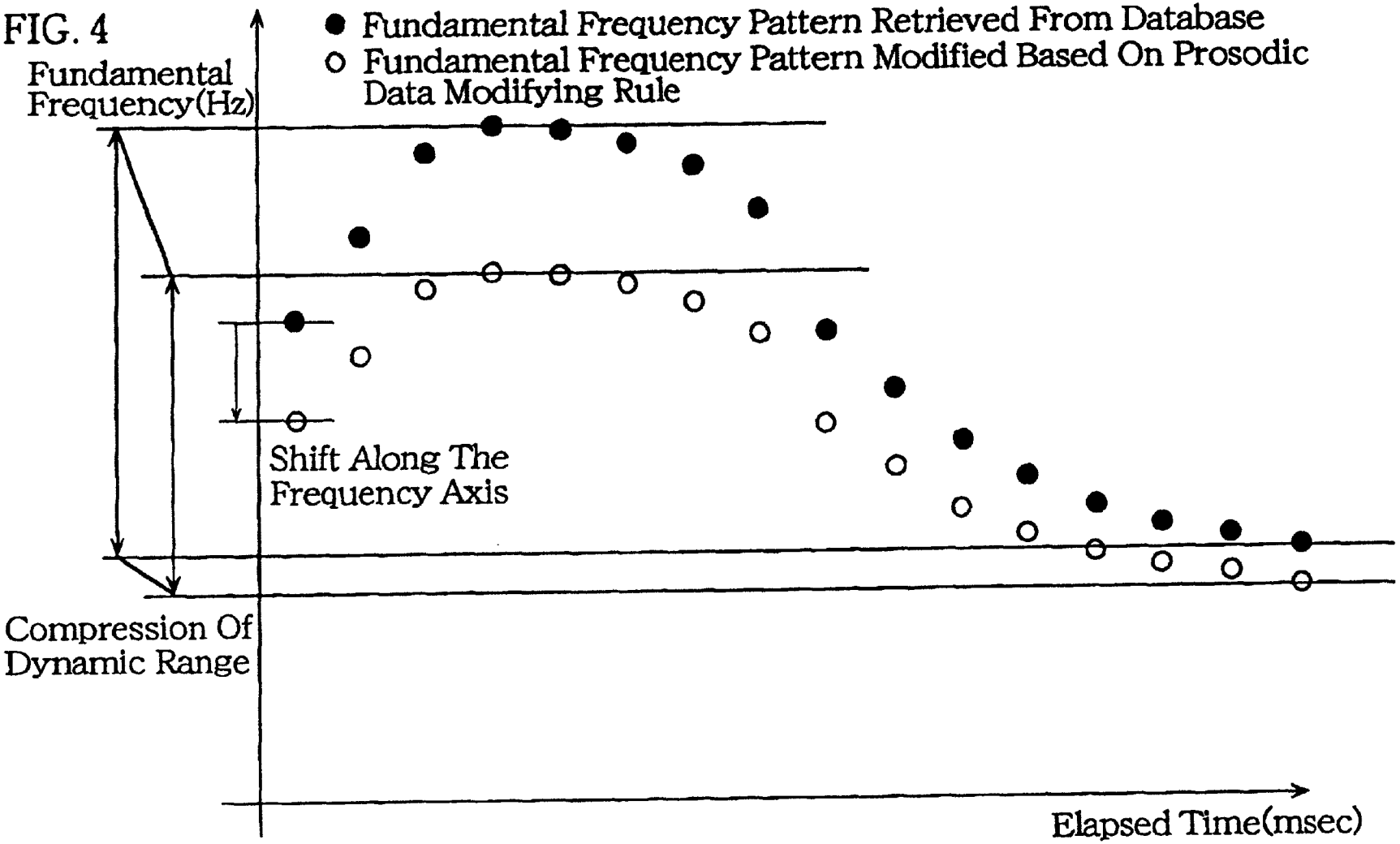
FIG. 4 illustrates an example of modifying a fundamental frequency pattern.

(3) According to the approximate cost received from the prosodic data retrieving section 140, the prosodic data modifying section 150 modifies the prosodic data (a fundamental frequency pattern, a voice intensity pattern, and a phonological segment duration pattern) which are outputted as the retrieved data from the prosodic data retrieving section 140, using a rule stored in the prosodic data modifying rule storing section 160. More specifically, for example, when a modifying rule to compress the dynamic range of the fundamental frequency pattern should be applied, the modification of a fundamental frequency pattern as shown in FIG. 4 is performed.

The data modification according to an approximate cost as described above has the technical significance as follows. Referring now to FIG. 5, assume that the prosodic data corresponding to "名古屋市 ('Nagoya-shi')" is retrieved instead of the actual input text "門真市 ('Kadoma-shi')", for example. Since the phoneme strings of the two are different from each other but the other retrieval items match (i.e., the approximate cost is small), the appropriate speech synthesis can be performed by using the prosodic data of "名古屋市 ('Nagoya-shi')" without modifying. Then, assuming that "なるんです ('narundesu')" is retrieved instead of the desired "5分です ('go-fun desu')", it is desirable in order to obtain the appropriate synthesized speech for "5分です ('go-fun desu')" that, if the difference in parts of speech is taken into consideration, the voice intensity pattern for "なるんです ('narundesu')" should be reduced somewhat, whereas if the bunsetsu data (for example the importance in meaning) is taken into consideration, the voice intensity pattern for "なるんです ('narundesu')" should be increased somewhat because generally the voice intensity for a number is large. Considering all the factors together, it is desirable that overall, the voice intensity for "なるんです ('narundesu')" be increased somewhat. Such an overall degree of data modification has a correlation with the approximate cost, and therefore, by storing a degree of modification (such as a multiplication factor of the modification) as a modifying rule in the prosodic data modifying rule storing section 160, an appropriate synthesized speech can be obtained. It is noted here that the modification of prosodic data in the present invention is not limited to the example shown in FIG. 4 in which the data is equally modified through the entire elapsed time. For example, the degree of modification may be varied as the time elapses by employing a modification pattern such that the data at and around the middle point during the elapsed time are primarily modified. Examples of specific ways of storing the modifying rule may include the following; a coefficient for converting an approximate cost into a multiplication factor of modification may be stored as the modifying rule, or it is possible to employ such a table that, by using the approximate costs as a parameter, corresponding multiplication factors of modification and modifying patterns are listed. The approximate cost used for the data modification is not limited to the same approximate cost used for the data retrieval as described above. An expression with coefficients a1–a7 different from those in Expression 1 above may be employed to obtain such values that result in more appropriate data modification. Further, different values may be employed for each of the fundamental frequency pattern, the voice intensity pattern, and the phonological segment pattern. In addition, in the case where a term in the above Expression 1 can be a negative value, the sum of the absolute values for all the terms is used as an approximate cost (0 or a positive value) for the data retrieval, and the sum of the terms as they are (which can be a negative value) is used as an approximate cost for the data modification.

(4) The waveform generating section 170 generates a speech waveform based on the phonetic character string received from the language processing section 120 and the prosodic data modified by the prosodic data modifying section 150, in other words, based on the phoneme string and pause length, and the fundamental frequency pattern, the voice intensity pattern, and the phonological segment duration pattern, and outputs the analog speech signal. Using the analog speech signal, the electroacoustic transducer 180 produces a synthesized speech.

As detailed above, even when the corresponding prosodic data having a retrieval key that exactly matches the search key is not stored in the prosodic information database 130, a speech synthesis system of the present invention performs speech synthesis by using similar prosodic data, achieving a reasonably appropriate, smooth, and natural sounding speech. Alternatively, a system according to the present invention can reduce a required storage capacity of the prosodic information database 130 without degrading naturalness of the synthesized speech. Furthermore, where similar prosodic data are used as mentioned above, the prosodic data are modified according to a degree of similarity thereof, and therefore more appropriate synthesized speech can be produced.

EXAMPLE 2

A speech synthesis system of Example 2 according to the present invention is now detailed. In the speech synthesis system of Example 2, a pause length preceding or following an accent phrase is also stored in the prosodic information database as part of the prosodic data. It is noted here that in this and following Examples, like elements having similar functions to those in Example 1 are designated by like reference numerals, and not further elaborated upon.

Figure 6:
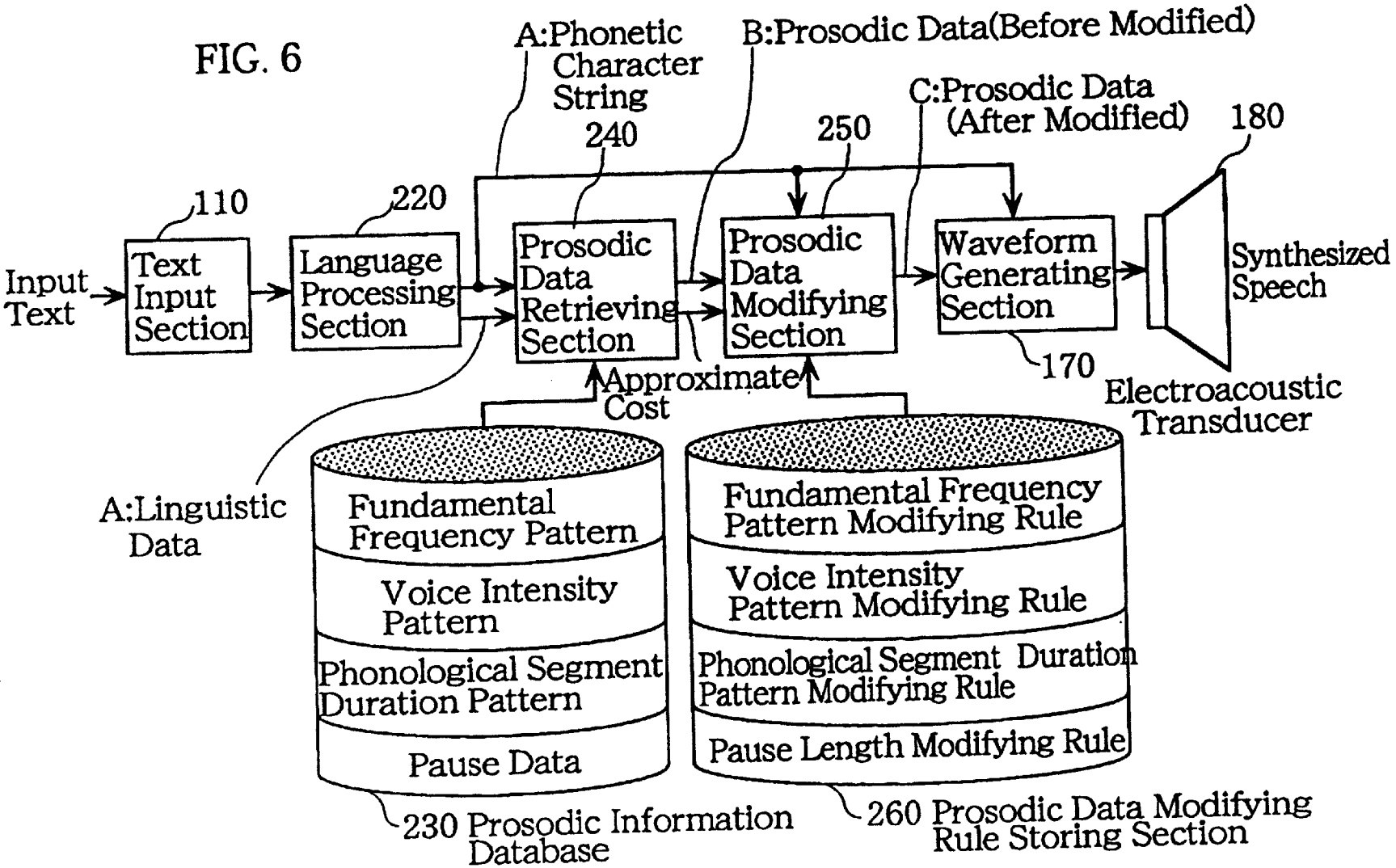
FIG. 6 is a functional block diagram for illustrating an embodiment of a speech synthesis system of Example 2 in accordance with the invention.

FIG. 6 shows a functional block diagram illustrating a configuration of the speech synthesis system of Example 2. This speech synthesis system of Example 2 differs from the speech synthesis system of Example 1 in the following points.

(a) Unlike the language processing section 120, a language processing section 220 outputs a phonetic character string in which pause data is not included.

(b) As shown in FIG. 7, unlike the prosodic information database 130, a prosodic information database 230 stores pause data as one of the prosodic data, not as a retrieval key. Note here that in an actual system, it is possible to employ the same data configuration as that of the prosodic information database 130 so that in the data retrieval operation, the pause lengths may be handled as part of the prosodic data.

(c) A prosodic data retrieving section 240 performs data retrieval by finding a match between a search key in which a pause data is not included and a retrieval key, and outputs the pause data as part of the prosodic data, in addition to the fundamental frequency pattern, the voice intensity pattern, and the phonological segment duration pattern.

(d) A prosodic data modifying section 250 modifies the pause data in response to the approximate cost, as well as modifying the prosodic data such as the fundamental frequency patterns and so forth.

(e) A prosodic data modifying rule storing section 260 stores a pause length modifying rule in addition to the fundamental frequency pattern modifying rule and so forth.

As discussed above, by utilizing the pause data retrieved from the prosodic information database 230, the speech synthesis system can produce a synthesized speech with more natural pause lengths. Furthermore, the load of input text processing can be reduced in the language processing section 220.

Additionally, as in Example 1 above, the pause data output from the language processing section can be employed as a search key so that accuracy of the retrieval can be easily increased. In such a case, the prosodic information database may store the pause data as a retrieval key and the pause data as a prosodic data separately, or may use the same pause data. In the case where the pause data is both outputted from the language processing section and stored in the prosodic information database, which of the pause data is to be used for speech synthesis can be determined depending on the accuracy of parsing in the language processing section and the reliability of the pause data retrieved from the prosodic information database. Further, which of the pause data is to be used may be determined depending on the approximate cost (accuracy of the retrieved data).

EXAMPLE 3

A speech synthesis system of Example 3 according to the present invention is now detailed. In the speech synthesis system of Example 3, the retrieval of and the modification of the prosodic data are performed based on different approximate costs for a fundamental frequency pattern, a voice intensity pattern, and a phonological segment duration pattern.

Figure 8:
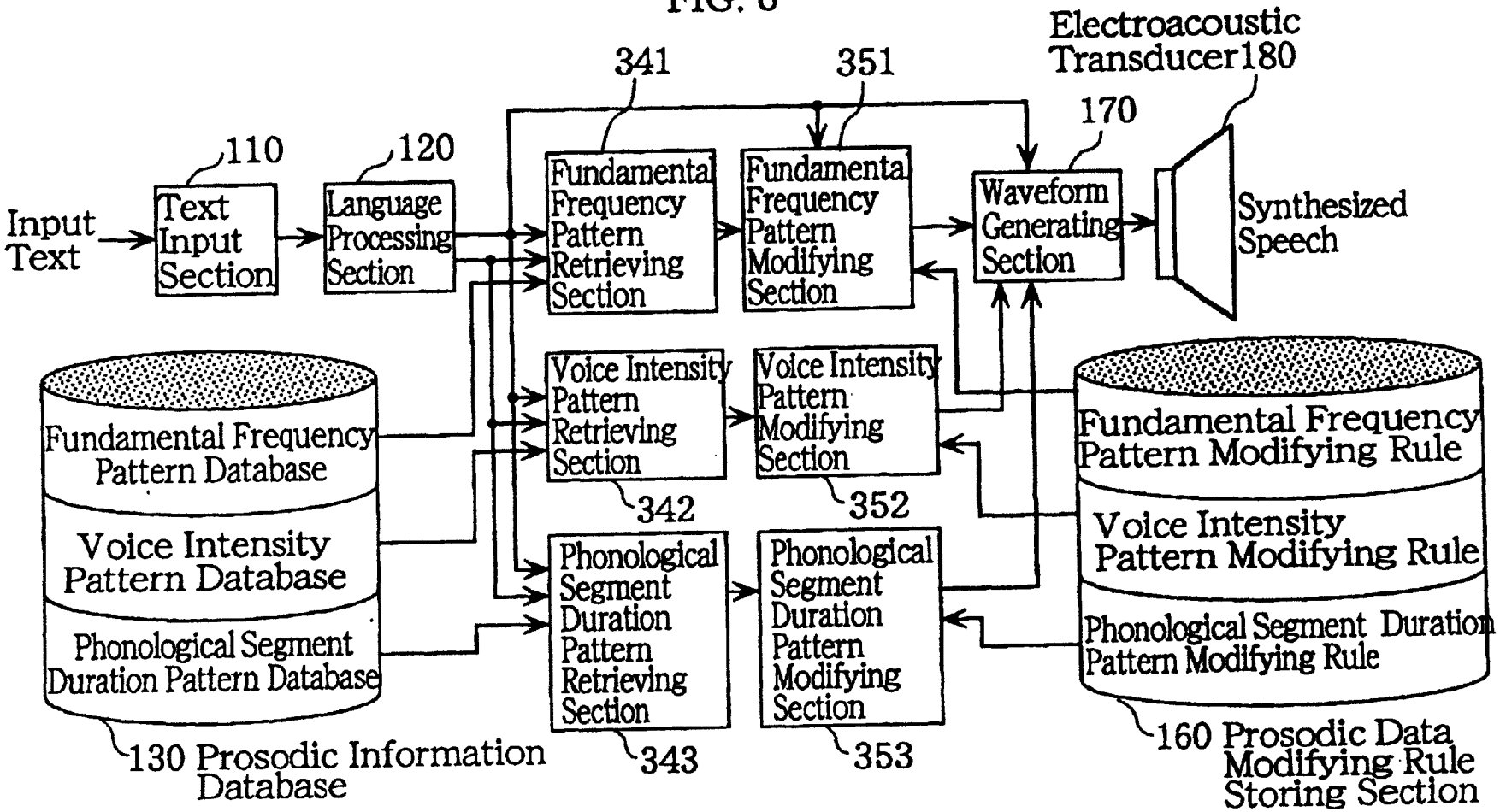
FIG. 8 is a functional block diagram for illustrating an embodiment of a speech synthesis system of Example 3 in accordance with the invention.

FIG. 8 shows a functional block diagram illustrating a configuration of the speech synthesis system of Example 3.

This speech synthesis system of Example 3 differs from the speech synthesis system of Example 1 in the following points.

(a) In place of the prosodic data retrieving section 140, a fundamental frequency pattern retrieving section 341, a voice intensity pattern retrieving section 342, and a phonological segment duration pattern retrieving section 343 are provided.

(b) In place of the prosodic data modifying section 150, a fundamental frequency pattern modifying section 351, a voice intensity pattern modifying section 352, and a phonological segment duration pattern modifying section 353 are provided.

In this example, the retrieving sections 341–343 and the modifying sections 351–363 are so constructed that the fundamental frequency pattern, the voice intensity pattern, and the phonological segment duration pattern are separately retrieved (the candidates are separately selected) and modified by using each of the approximate costs obtained from the following Expressions 2 to 4.

[Expression 2] (Data Retrieval and Modification of a Fundamental Frequency Pattern)

$$C=b1\cdot D1+b2\cdot D2+b3\cdot D3+b4\cdot D4+b5\cdot D5+b6\cdot D6+b7\cdot D7$$

[Expression 3] (Data Retrieval and Modification of a Voice Intensity Pattern)

$$C=c1\cdot D1+c2\cdot D2+c3\cdot D3+c4\cdot D4+c5\cdot D5+c6\cdot D6+c7\cdot D7$$

[Expression 4] (Data Retrieval and Modification of a Phonological Segment Duration Pattern)

$$C=d1\cdot D1+d2\cdot D2+d3\cdot D3+d4\cdot D4+d5\cdot D5+d6\cdot D6+d7\cdot D7$$

Here, D1 to D7 in the above expressions are the same as those in Expression 1 of Example 1, but the weighting coefficients b1 to b7, c1 to c7, and d1 to d7 are different from a1 to a7 in Expression 1 in that those coefficients employed in this example are each obtained by a statistical method, learning, or the like so that an appropriate pattern can be selected for each of the fundamental frequency pattern, the voice intensity pattern, and the phonological segment duration pattern. For example, the fundamental frequency patterns generally become similar between the two if the accent positions and the numbers of morae are the same, and therefore the coefficients b2 and b3 are made larger than the coefficients a2 and a3 in Expression 1. In the voice intensity patterns, the presence or absence of a pause and the length thereof has a large degree of influence on the matching of the voice intensity patterns, and therefore the coefficients c4 and c5 are made larger than the coefficients a4 and a5. Likewise, in the phonological segment duration patterns, the order in the phoneme string has a large degree of influence on the matching of the phonological segment duration patterns, and therefore the coefficient d1 is made larger than the coefficient a1.

As described above, data retrieval and modification are separately performed for each of the prosodic data such as the fundamental frequency pattern and so forth by using discrete approximate costs, and accordingly, well-balanced data retrieval and modification are achieved, and speech synthesis is performed based on the optimum fundamental frequency pattern, optimum voice intensity pattern, and optimum phonological segment duration pattern. Furthermore, the prosodic information database 130 does not need to store the fundamental frequency patterns, the voice intensity patterns, and the phonological segment duration patterns such that a fundamental frequency pattern, a voice intensity pattern, and a phonological segment duration pattern constitute a set of prosodic feature data, but for example, the prosodic information database 130 can store the patterns separately. Accordingly, with a relatively small storage capacity of the prosodic information database 130, synthesized speech with good sound quality can be generated.

EXAMPLE 4

Now, a speech synthesis system of Example 4 according to the present invention is detailed.

Figure 9:
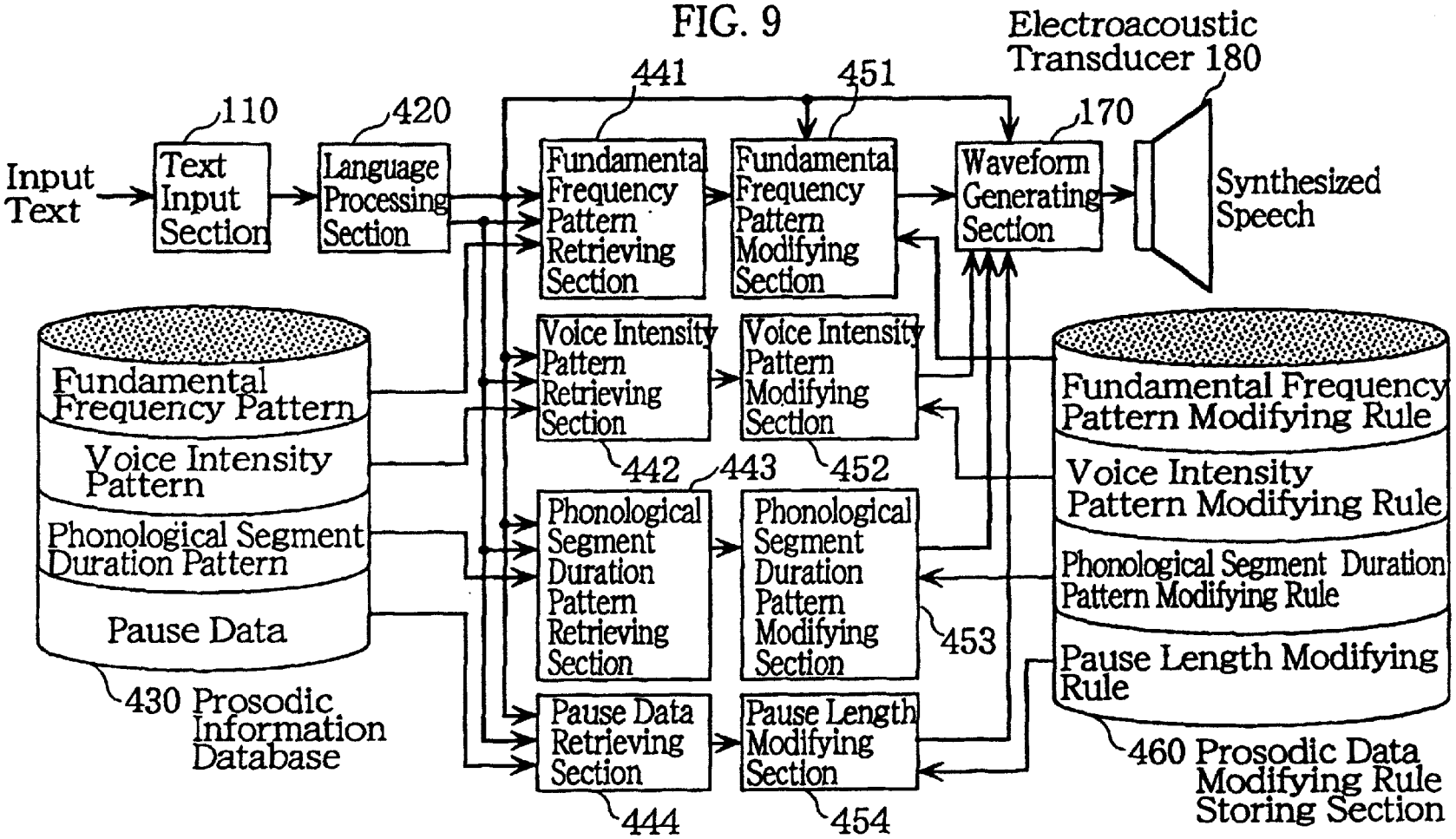
FIG. 9 is a functional block diagram for illustrating an embodiment of a speech synthesis system of Example 4 in accordance with the invention.

FIG. 9 shows a functional block diagram illustrating a configuration of the speech synthesis system of Example 4. This speech synthesis system has the following primary features.

(a) Unlike the speech synthesis systems of Examples 1 to 3 described above, the processing of prosodic data such as retrieving and modifying is performed using a phrase, not an accent phrase, as a unit for the processing. The "phrase" herein is a set of a plurality of accent phrases, which normally forms a group when a speech is vocalized (as does the group that is separated by a "kuten" (period in Japanese)), and is also referred to as a breath group.

(b) As in the system of Example 2, the speech synthesis system of Example 4 comprises a prosodic information database 430 in which pause data are stored as part of the prosodic data, and a prosodic data modifying rule storing section 460 in which a pause length modifying rule is stored as well as the prosodic data modifying rule such as the fundamental frequency pattern modifying rule and so forth. However, the prosodic information database 430 and the prosodic data modifying rule storing section 460 differ from the prosodic information database 230 and the prosodic data modifying rule storing section 260 of Example 2, in that the prosodic data and the modifying rules are stored using the phrase as a unit, as shown in FIG. 10.

(c) As in the system of Example 3, the retrieval and modification of prosodic data are performed based on separate approximate costs for each of the prosodic data such as the fundamental frequency pattern and so forth. In addition, the retrieval and modification of the pause data are also performed separately.

(d) Modification of the prosodic data is performed according to approximate costs, as in the systems of Examples 1 to 3, and further, performed according to a degree of matching between each of the phonemes in the phoneme strings of a search key and a retrieval key.

The details are given below.

A language processing section 420 parses an input text fed from the text input section 110, divides the text into accent phrases in the manner analogous to that of the language processing section 120 of Example 1, and outputs a phonetic character string and linguistic data for each of the phrases, each of which is a set of predetermined accent phrases.

In the prosodic information database 430, prosodic data for each of the phrases is stored in such a manner that a phrase forms a unit, and accordingly, as shown in FIG. 10, the number of the accent phrases contained in each of the phrases is also stored. It is noted that pause data stored as part of the prosodic data may contain the lengths of the pauses preceding and following an accent phrase, as well as the lengths of the pauses preceding and following a phrase.

A fundamental frequency pattern retrieving section 441, a voice intensity pattern retrieving section 442, a phonological segment duration pattern retrieving section 443, and a pause data retrieving section 444 are configured such that the number of the accent phrases contained in a phrase is taken into consideration as an approximate cost, so as to be able to retrieve prosodic data using a phrase as a unit. These sections except the pause data retrieving section 444 are so configured that they output a degree of matching between the phonemes in the phoneme strings of a search key and a retrieval key, in addition to the retrieved data, such as a fundamental frequency pattern etc., and the approximate costs. The pause data retrieving section 444 outputs a degree of matching between the number of mora or morae, the accent position or positions, and the like in each accent phrase, in addition to the pause data and the approximate cost.

A fundamental frequency pattern modifying section 451, a voice intensity pattern modifying section 452, and a phonological segment duration pattern modifying section 453 modify the prosodic data according to the approximate costs received from the retrieving sections such as the fundamental frequency pattern retrieving section 441 and so forth, in the manner analogous to those of the prosodic data modifying section 150 and so forth in Examples 1 to 3, using the rule stored in a prosodic data modifying rule storing section 460. These modifying sections also modify the prosodic data according to the degree of matching between the phonemes in the phoneme strings of a search key and a retrieval key. More specifically, it is easy to modify the prosodic data in such a manner that, in a case where the prosodic data of a word in which only a part of the word has a different phoneme is used in place of the data of a required word, for example, as in the case where the prosodic data of a word "たかな ('takana', meaning a kind of 'leaf mustard')" is used in place of the prosodic data of a word "さかな ('sakana', meaning 'fish')", the voice intensity pattern for the different phoneme is weakened as indicated by the reference character "P" in FIG. 2 so that the effect of the phoneme difference cannot be easily recognized. It is to be understood that such modifying according to the degree of matching between the phonemes may or may not be employed, and that it is also possible to employ only the modifying according to a degree of matching between each of the phonemes and not employ the modifying according to approximate costs.

A pause length modifying section 454, using the rule stored in the prosodic data modifying rule storing section 460, modifies the prosodic data according to the approximate cost received from the pause data retrieving section 444, and in addition, modifies a pause length or lengths according to a degree of matching between the numbers of morae, the accent position positions, or the like in each accent phrase.

As described above, the system of this example can generate more natural sounding synthesized speech that reflects the flow of the sentences by performing the retrieval and modification of prosodic data using a phrase as a unit. In addition, as in the system of Example 2, the system of this example can generate a synthesized speech with more natural pause lengths by using the pause data retrieved from the prosodic information database 430. Further, as in the system of Example 3, the system of this example performs the retrieval and modification of the prosodic data by using separate approximate costs for each of the prosodic data such as the fundamental frequency pattern and so forth, and thereby the system can produce a synthesized speech based on the most appropriate prosodic data such as the fundamental frequency pattern and so forth, which enables the system to reduce a required storage capacity of the prosodic information database 430. Furthermore, the system of this example modifies the prosodic data such as the fundamental frequency pattern and so forth according to the degree of matching between each of the phonemes, and thereby makes the adverse effect by the difference in phonemes not easily recognized. In addition, the pause lengths and the like are modified according to a degree of matching between the numbers of morae or the accent positions in each of the accent phrases, which results in a synthesized speech with more natural pause lengths.

EXAMPLE 5

A speech synthesis system of Example 5 according to the present invention is now detailed. The speech synthesis system of Example 5 employs a phonological segment category string for the retrieval of prosodic data.

Figure 11:
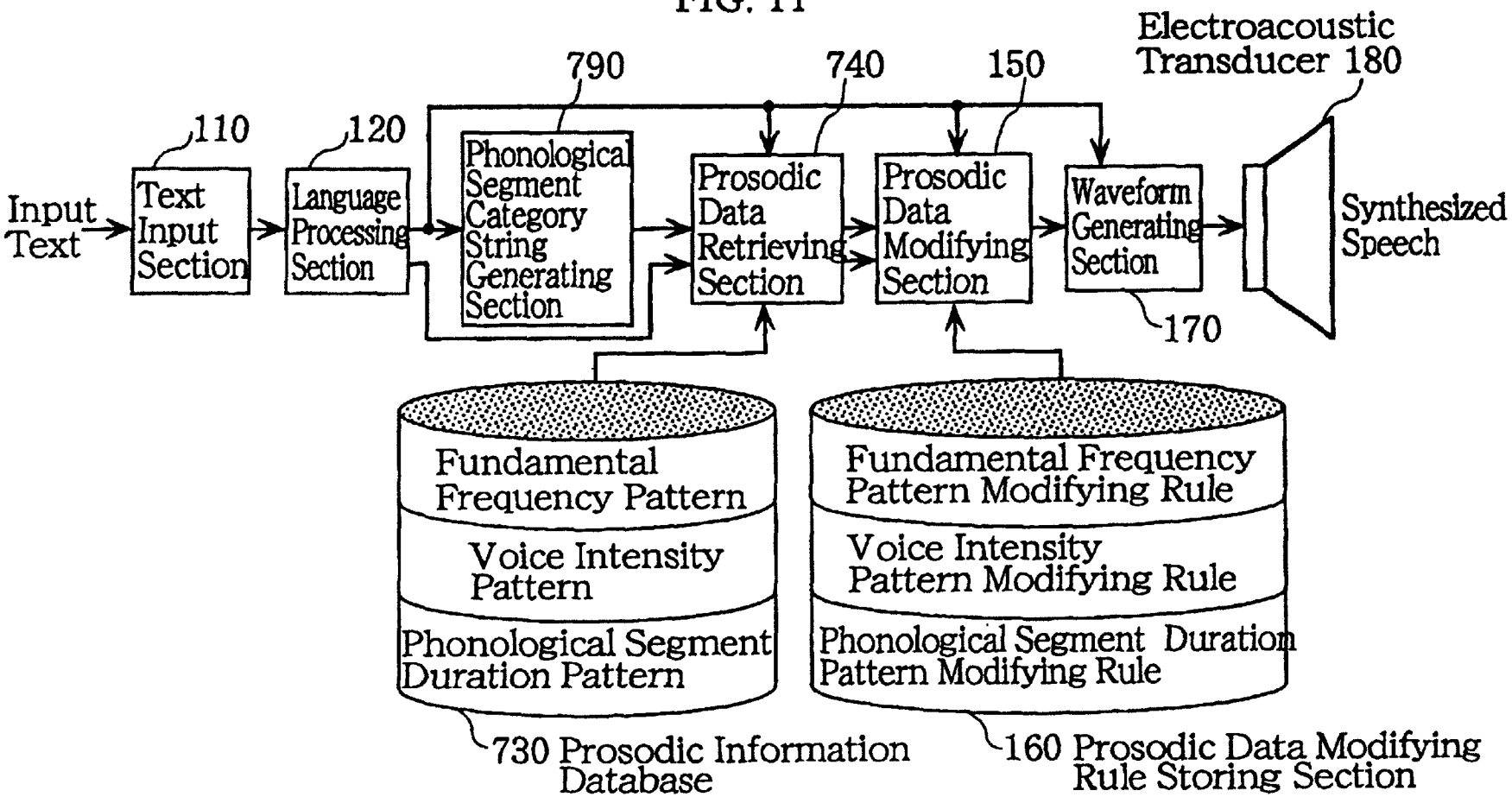
FIG. 11 is a functional block diagram for illustrating an embodiment of a speech synthesis system of Example 5 in accordance with the invention.
Figure 12:
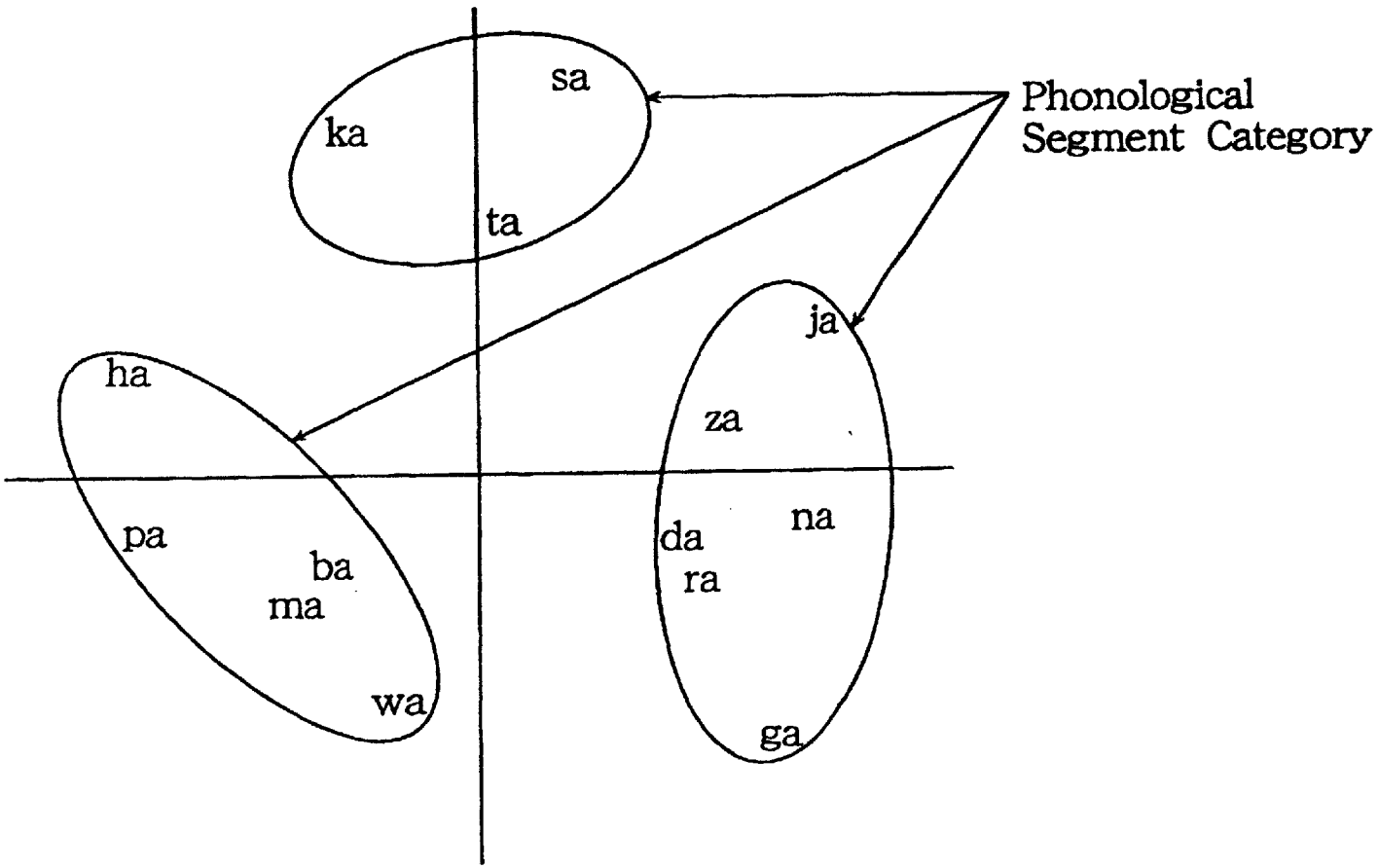
FIG. 12 schematically shows examples of phonological segment categories.
Figure 13:
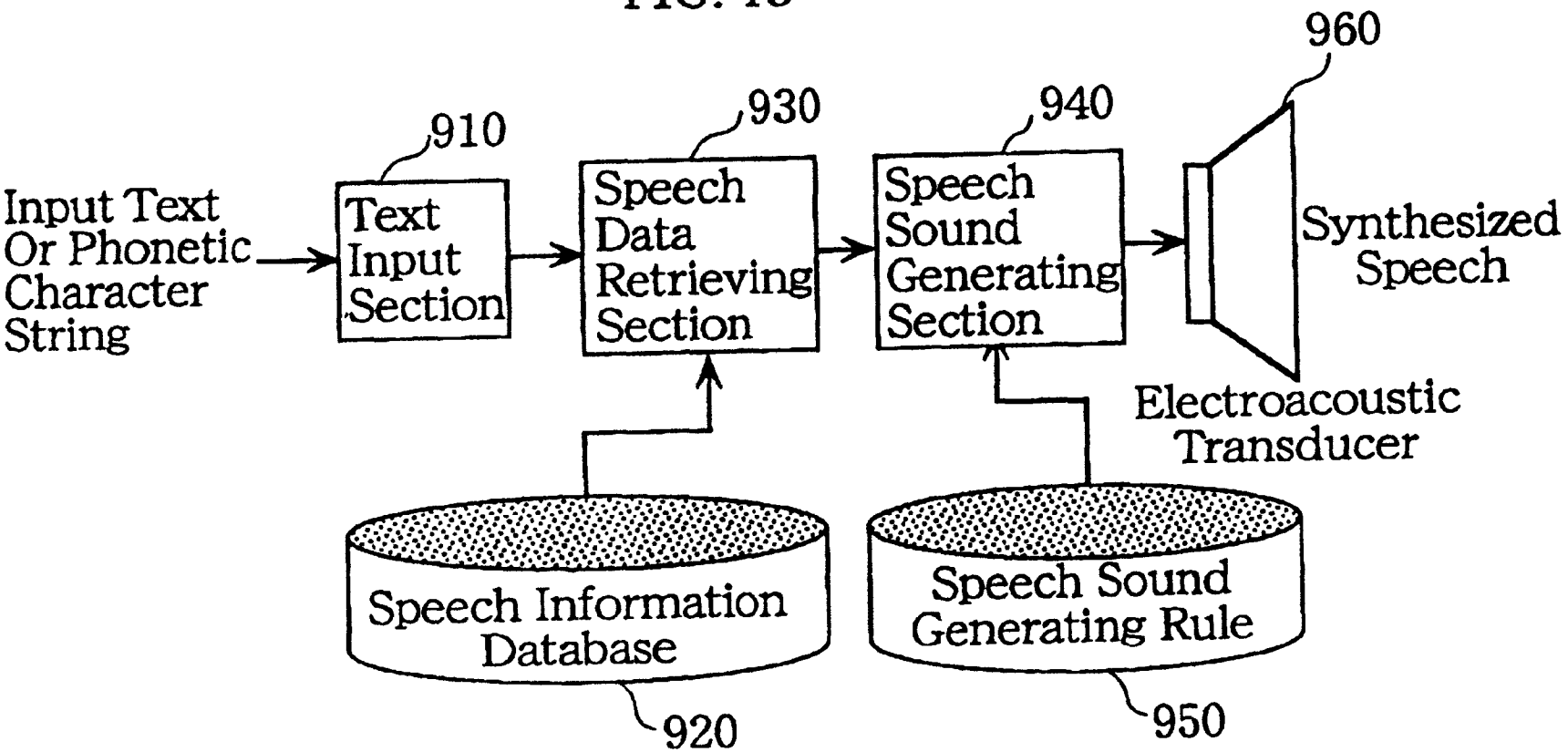
FIG. 13 is a functional block diagram for illustrating a prior art speech synthesis system.

FIG. 11 shows a functional block diagram illustrating a configuration of the speech synthesis system of Example 5. FIG. 12 shows an example of the phonological segment categories.

It is noted here that the phonological segment categories refer to the categories of phonological segments, and in each of the categories, phonological segments are grouped by using a distance obtained from phonetical features of each phonological segment, i.e., by such factors as a manner of articulation of each phonological segment, a place of articulation thereof, and a duration thereof. Specifically, the phonemes in the same phonological segment category have similar acoustic characteristics, and therefore in most cases, when two accent phrases have some of the phonemes that are different from each other but belong to the same phonological segment category, the two accent phrases tend to have the prosodic data identical or reasonably similar to each other. Therefore, when the phonemes do not match but the phonological segment categories match each other in the retrieval of the prosodic data, an appropriate and natural sounding speech can be produced in most cases even by utilizing the prosodic data of non-matching phonemes. The grouping of phonological segments is not limited to the manner described above. For example, as shown in FIG. 12, phonological segments may be grouped according to the distances (psychological distances) between each of the phonemes determined by a multivariate analysis or the like by using a confusion matrix between the phonological segments each other. Further, phonological segments may be grouped according to a similarity between physical characteristics (fundamental frequency, voice intensity, duration, spectrum, and so forth). Or, it may be such that prosodic patterns are grouped by using a statistical method such as a multivariate analysis, and the phonological segments are grouped by using a statistical method so as to best reflect the grouped prosodic patterns.

Now, the details are discussed below. Compared to the speech synthesis system of Example 1, the speech synthesis system of Example 5 comprises a prosodic information database 730 in place of the prosodic information database 130, and further comprises a phonological segment category string generating section 790.

The prosodic information database 730 stores, as a retrieval key, phonological segment category strings each representing a phonological segment category to which the phonemes in the accent phrases belong, in addition to the stored data of the prosodic information database 130 of Example 1. Regarding the specific notation of phonological segment category strings, for example, a string of the numbers or characters each allotted for each phonological segment category may be employed, or, by selecting any one of the phonemes in each phonological segment category as a representing phoneme, and a string of the selected phonemes may be employed for the purpose.

The phonological segment category string generating section 790 receives from the language processing section 120 a phonetic character string for each accent phrase, and converts the phonetic character strings into a phonological segment category string.

A prosodic data retrieving section 740 retrieves the prosodic data in the prosodic information database 730 based on the phonological segment category string received from the phonological segment category string generating section 790, and the phonetic character string and the linguistic data both of which are received from the language processing section 120, and outputs the retrieved prosodic data and an approximate cost. The approximate cost contains the degree of matching between each phonological segment category (for example, a degree of similarity between each phonological segment), and accordingly, even if the phoneme strings do not match, a small value can be obtained as long as the phonological segment categories match. Thereby, more appropriate prosodic data are retrieved (selected), and natural sounding synthesized speech is produced. In addition, by limiting the candidates to those with a matching or similar phonological segment category string, for example, the speed of retrieving can be easily improved.

In the example above, the phonetic character strings from the language processing section 120 are converted into phonological segment category strings by the phonological segment category string generating section 790. However, the present invention is not so limited. The language processing section 120 may have a function of generating phonological segment category strings, or the prosodic data retrieving section 740 may have a function of converting the input phonetic character strings into phonological segment category strings. If the prosodic data retrieving section 740 has a function of converting the phoneme strings read out from the prosodic information database into phonological segment category strings, it is possible to employ the prosodic information database 130 as that in Example 1 in which the phonological segment category strings are not stored.

In addition, it is not essential to use both phoneme string and phonological segment category string as a retrieval key, and it is possible to use only the phonological segment category string. By doing so, the prosodic data differing only in the phoneme string can be put together, which easily makes it possible to reduce a required capacity of the database and to improve the speed of retrieving.

It is to be understood that the constituent elements described above as the examples and variations may be combined in various manners. For example, the technique in Example 5 wherein phonological segment category strings are used in the retrieval of prosodic data or the like may be employed for other examples herein.

In addition, the modification of prosodic data according to the degree of matching between each of the phonemes, which is described in Examples 3 and 4, may be employed in the other examples in place of or in combination with the modification according to the approximate costs. Further, the modification may be performed by using, as a unit of modifying, a degree of matching between each phoneme, each mora, each syllable, each unit of generating a speech waveform in the waveform generating section, or each phonological segment. Further, it is possible to select which of the degrees of matching is to be used, depending on the prosodic data to be modified. Specifically, for example, it is possible that either of the approximate cost or the degree of matching between each phoneme or the like is used for modifying the fundamental frequency pattern, or both are used for modifying the voice intensity pattern. It is noted here that the degree of matching between each phoneme or the like described above can be determined based on a distance obtained from acoustic characteristics such as the fundamental frequency, the intensity, the duration, the spectrum, or can be determined based on a distance obtained phonetically such as the fundamental frequency, the manner of articulation, the place of articulation, the duration, or can be determined based on a distance obtained from a confusion matrix made by an auditory experiment.

In addition, the technique described in Example 5 in which phonological segment categories are utilized in retrieving and so forth may be employed in place of or in addition to using a phoneme string in the other examples herein.

Further, the constitution of the invention as shown in Examples 2 and 4 in which pause data are stored as one of the prosodic data in the prosodic information database so as to be retrieved may be applied to other examples herein, or alternatively, in Examples 2, 4, and so forth, the pause data may be employed in the data retrieval.

The language processing section is not essential, and the phonetic character strings or the like may be externally provided. This is particularly useful in the application to small-sized devices such as mobile phones, since it easily achieves reduction of device size or compression of the data for telecommunication. Further, the phonetic character string and the linguistic data may be provided from an external apparatus. More specifically, for example, it is possible that a high accuracy language processing is performed using a large scale server, and the result is received so as to produce more appropriate speech. Alternatively, the configuration of the system can be simplified by using only a phonetic character string.

In addition, the prosodic data for synthesizing a speech is not limited to the above examples. For example, in place of the phonological segment duration pattern, a phoneme duration pattern, a mora duration pattern, a syllable duration pattern, and the like may be employed. Further, various prosodic data may be combined including the duration patterns listed above.

In addition, the prosody controlling unit, i.e., the unit for such as storing, retrieving, and modifying may be either one of an accent phrase or a phrase comprising one or more accent phrases, and may be a syllable, a word, a stress phrase, or a phrase composed of one or more 'bunsetsu's, words, or stress phrases, or the combinations thereof. Further, in addition to the prosody controlling unit (for example a phrase composed of one or more accent phrases), a degree of matching between the numbers of morae or accent positions in another unit (for example an accent phrase) may be separately employed for modifying prosodic data.

Furthermore, the numbers and items of the search key are not limited to the examples above. Specifically, when the number of items of the search key is larger, it is, in general, more likely that candidates that are more appropriate are selected. However, it is possible that the number of items of the search key is optimized along with the degrees of matching between and weighting of each item so that the most appropriate candidate is easily selected. Further, a search key that does not have much influence on the accuracy of the search may be omitted to simplify the system configuration and to improve the processing speed.

In the examples above, the Japanese language is described as an example of an applicable language, but of course, the invention is not limited thereto and can be suitably applied to various other languages. In such cases, the modification of the prosodic data may be such as to meet the requirements according to the characteristics of the language, and for example, the processing using a mora as a unit may be adjusted so that a mora or a syllable is a unit of the processing. In addition, the data for a plurality of languages may be stored in the prosodic information database 130 and so forth.

The configurations described above may be implemented by a computer (and the peripheral devices) and a program, or by hardware.

INDUSTRIAL APPLICABILITY

As has been discussed thus far, the present invention achieves the following advantageous effects. A database stores prosodic data extracted from actual human speech, such as a fundamental frequency pattern, a voice intensity pattern, a phoneme duration pattern, pause data, and the like, and such prosodic data that results in the least approximate cost for a target speech inputted such as a text and a phonetic character string is searched and retrieved from the prosodic information database. Then, the retrieved data is modified based on a predetermined modifying rule according to the approximate cost, a degree of matching, or the like. Thereby, a natural sounding synthesized speech can be produced corresponding to arbitrary input text or the like. In particular, regardless of whether or not a speech content data corresponding to an input such as an input text is present, a similar sound quality can be obtained, that is, a natural sounding synthesized speech which as a whole is close to actual human speech can be obtained. Hence, the present invention is applicable to various electronic appliances such as electric home appliances, vehicle navigation systems, and mobile phones to enable the appliances to produce audible messages showing conditions of the appliances, directions of the operation, response messages and the like. The invention is also applicable to personal computers or the like to enable them to be operated by a voice interface, or to confirm the result of character recognition by optical character recognition (OCR). Thus, the present invention is useful in such fields as those listed above.

What is claimed is:

1. A speech synthesis system for generating synthesized speech based on input data representing speech to be synthesized, the system comprising:

a database storing prosodic data for use in synthesizing speech, the prosodic data corresponding to key data being used as a retrieval key;

means for retrieving the prosodic data according to a degree of matching between such input data and such key data; the degree of matching represented by an approximate cost determining by a cost method, whereby a smallest approximate cost corresponds to a highest degree of said matching;

prosodic data modifying rule means for storing a degree of modification of the prosodic data corresponding to the approximate cost, the degree of modification stored as a modifying rule;

means for modifying the prosodic data retrieved by the means for retrieving based on such input data, the degree of matching between such input data and such key data, and the modifying rule stored in the prosodic data modifying rule means; and means for synthesizing a synthesized speech based on such input data and the prosodic data modified by the means for modifying.

2. The speech synthesis system according to claim 1, wherein each of such input data and such key data comprises a phonetic character string representing a phonetic attribute of the speech to be synthesized.

3. The speech synthesis system according to claim 2, wherein each of such input data and such key data further comprises linguistic data representing a linguistic attribute of the speech to be synthesized.

4. The speech synthesis system according to claim 3, wherein such linguistic data comprises at least one of syntactic data and semantic data of the speech to be synthesized.

5. The speech synthesis system according to claim 3, further comprising a language processing means for parsing text data inputted in the speech synthesis system and producing a processed phonetic character string and processed linguistic data.

6. The speech synthesis system according to claim 2, wherein the phonetic character string comprises data substantially indicating at least one of a phonological segment string of the speech to be synthesized, an accent position in the speech to be synthesized, and either one of the presence or absence and the length of a pause in the speech to be synthesized.

7. The speech synthesis system according to claim 1, wherein each of such input data and such key data comprises a phonological segment category string representing a phonological segment category to which a phonological segment in the speech to be synthesized belongs.

8. The speech synthesis system according to claim 7, further comprising means for converting data into the phonological segment category string, the data being at least one data of data corresponding to such input data inputted to the speech synthesis system and data corresponding to retrieval key data stored in the database.

9. The speech synthesis system according to claim 7, wherein the phonological segment category is such that phonological segments are categorized by using at least one of a manner of articulation thereof, a place of articulation thereof, and a duration thereof.

10. The speech synthesis system according to claim 7, wherein the phonological segment category is such that prosodic patterns are grouped by using a statistical method, and that the phonological segments are grouped so as to best reflect the grouped prosodic patterns.

11. The speech synthesis system according to claim 10, wherein the statistical method is a multivariate analysis method.

12. The speech synthesis system according to claim 7, wherein the phonological segment category is such that the phonological segments are grouped according to a psychological distance between each of the phonemes of each phonological segment, each distance being determined based on a confusion matrix by using a statistical method.

13. The speech synthesis system according to claim 12, wherein the statistical method is a multivariate analysis method.

14. The speech synthesis system according to claim 7, wherein the phonological segment category is such that the phonological segments are grouped according to a similarity of a physical characteristic between the phonological segments.

15. The speech synthesis system according to claim 14, wherein the physical characteristic is at least one characteristic of the phonological segments selected from a fundamental frequency thereof, an intensity thereof, a duration thereof, and a spectrum thereof.

16. The speech synthesis system according to claim 1, wherein the prosodic data stored in the database comprises prosodic feature data extracted from an identical actual human voice.

17. The speech synthesis system according to claim 16, wherein the prosodic feature data comprises at least one of:

a fundamental frequency pattern representing a variation of a fundamental frequency with respect to time;

a voice intensity pattern representing a variation of a voice intensity with respect to time;

a phonological segment duration pattern representing a duration of a phonological segment; and a pause data representing one of the presence or absence of a pause and the length of a pause.

18. The speech synthesis system according to claim 1, wherein in the database, the prosodic data are stored in the database such that each prosodic data forms a prosody controlling unit.

19. The speech synthesis system according to claim 1, further comprising a prosody controlling unit comprising one of:

an accent phrase;

a phrase comprising one or more accent phrase;

a bunsetsu;

a phrase comprising one or more bunsetsus;

a word;

a phrase comprising one or more words;

a stress phrase; and a phrase comprising one or more stress phrases.

20. The speech synthesis system according to claim 1, wherein:

each of such input data and such key data comprises a plurality of types of speech indices each being a factor in determining a speech to be synthesized; and the degree of matching between such input data and such key data is such that in each type of the speech indices, a degree of matching between such input data and such key data is weighted, and the weighted data are combined together.

21. The speech synthesis system according to claim 20, wherein the speech indices comprises data substantially indicating at least one of a phonological segment string of the speech to be synthesized, an accent position in the speech to be synthesized, a linguistic data representing a linguistic attribute of the speech to be synthesized and one of the length of a pause and the presence or absence in the speech to be synthesized.

22. The speech synthesis system according to claim 21, wherein:

the speech indices comprises a data substantially indicating a phonological segment string of the speech to be synthesized; and the degree of matching between the speech indices in the input data and the speech indices in the key data includes a degree of similarity of acoustic feature data between phonological segments.

23. The speech synthesis system according to claim 20, wherein the speech indices comprises a phonological segment category string representing a phonological segment category to which a phonological segment in the speech to be synthesized belongs.

24. The speech synthesis system according to claim 23, wherein the degree of matching between the speech indices in the input data and the speech indices in such key data comprises a degree of similarity of the phonological segment category between the phonological segments.

25. The speech synthesis system according to claim 20, wherein the prosodic data comprises a plurality of types of prosodic feature data characterizing the speech to be synthesized.

26. The speech synthesis system according to claim 25, wherein the database is for storing the plurality of types of prosodic feature data so that the plurality of types of prosodic feature data comprises a set of prosodic feature data.

27. The speech synthesis system according to claim 26, wherein the plurality of types of prosodic feature data are extracted from an identical actual human voice.

28. The speech synthesis system according to claim 25, wherein the prosodic feature data comprises at least one of:

a fundamental frequency pattern representing a variation of a fundamental frequency with respect to time;

a voice intensity pattern representing a variation of a voice intensity with respect to time;

a phonological segment duration pattern representing a duration of a phonological segment; and a pause data representing one of the presence or absence of a pause and the length of a pause.

29. The speech synthesis system according to claim 28, wherein the phonological segment duration pattern comprises at least one of a phoneme duration pattern, a mora duration pattern, and a syllable duration pattern.

30. The speech synthesis system according to claim 25, further comprising means for retrieving and modifying each of the plurality of types of prosodic feature data according to the weighted degrees of matching between the input data and the key data, the weighted degrees of matching being different from each other.

31. The speech synthesis system according to claim 20, wherein the means for retrieving the prosodic data and the means for modifying the prosodic data are each for using a different weighted degree of matching between the input data and the key data.

32. The speech synthesis system according to claim 20, wherein the means for retrieving the prosodic data and the means for modifying the prosodic data are for using an identical weighted degree of matching between the input data and the key data.

33. The speech synthesis system according to claim 1, wherein the means for modifying is for modifying the prosodic data retrieved by the means for retrieving based on a degree of matching between one of:

each phoneme;

each mora;

each syllable;

each unit of generating a speech waveform in the means for synthesizing; and each phonological segment.

34. The speech synthesis system according to claim 33, wherein the degree of matching is determined based on at least one of:

a distance based on an acoustic characteristic;

a distance obtained from one of a manner of articulation, a place of articulation, and a duration; and a distance based on a confusion matrix obtained by an auditory experiment.

35. The speech synthesis system according to claim 34, wherein the acoustic characteristic is at least one characteristic of the phonological segments selected from a fundamental frequency thereof, an intensity thereof, a duration thereof, and a spectrum thereof.

36. The speech synthesis system according to claim 1, wherein the database is for storing key data and prosodic data of a plurality of types of languages.

37. A method of synthesizing speech based on input data representing speech to be synthesized, the method comprising:

storing in advance of a degree of modification of prosodic data in a prosodic data modifying rule means, the degree of modification corresponding to an approximate cost and being stored as a modifying rule;

retrieving prosodic data from a database in which prosodic data for use in synthesizing speech is stored corresponding to key data for use in retrieval, the prosodic data, the prosodic data retrieved according to a degree of matching between such input data and such key data, the degree of matching represented by the approximate cost determined by a cost method, whereby a smallest approximate cost corresponds to a highest degree of said matching;

modifying the retrieved prosodic data based on the degree of matching between such input data and such key data and the modifying rule stored in the prosodic data modifying rule means; and outputting synthesized speech based on the input data and the modified prosodic data.

38. The method of synthesizing a speech according to claim 37, wherein:

each of such input data and such key data comprises a plurality of types of speech indices each being a factor in determining a speech to be synthesized;

the degree of matching between such input data and such key data is such that in each type of the speech indices, a degree of matching between such input data and such key data is weighted, and the weighted data are combined together.

39. The method of synthesizing a speech according to claim 38, wherein the prosodic data comprises a plurality of types of prosodic feature data characterizing such input data.

40. The method of synthesizing a speech according to claim 39, wherein each of the plurality of types of prosodic feature data is retrieved and modified according to the weighted degrees of matching between such input data and such key data, the weighted degrees of matching being different from each other.

41. The method of synthesizing a speech according to claim 38, wherein the retrieving the prosodic data and the modifying the prosodic data are performed each using a different weighted degree of matching between such input data and such key data.

42. A method of synthesizing a speech according to claim 38, wherein the retrieving the prosodic data and the modifying the prosodic data are performed using an identical weighted degree of matching between such input data and such key data.

43. A speech synthesis system wherein an input text is converted into synthesized speech to be outputted, the system comprising:

language processing means wherein input text is parsed for outputting a phonetic character string and linguistic data;

a prosodic information database storing prosodic feature data, linguistic data, and a phonetic character string so that the prosodic feature data correspond to the linguistic data and the phonetic character string, the prosodic feature data being extracted from actual human speech, and phonetic character string and the linguistic data corresponding to speech to be synthesized;

a retrieving means for retrieving a prosodic feature data from the prosodic feature data stored in the prosodic information database, the retrieved prosodic feature data corresponding to at least a portion of retrieval items comprising the phonetic character string and the linguistic data outputted from the language processing means;

prosodic data modifying rule means for storing a degree of modification of prosodic data corresponding to the approximate cost, the degree of modification stored as a modifying rule;

a prosody modifying means for modifying the prosodic feature data according to the modifying rule in response to a degree of matching between the retrieval item and the data stored in the prosodic information database, the prosodic feature data being retrieved and selected from the prosodic information database, the degree of matching represented by the approximate cost, the modifying rule being the degree of modification corresponding to the approximate cost; and a waveform generating means for generating a speech waveform based on the prosodic feature data received from the prosody modifying means and the phonetic character string received from the language processing means.

* * * * *